United States Patent [19]

Henderson

[11] 4,078,358

[45] Mar. 14, 1978

[54] BAG-HANGING AND BAG-FILLING MACHINES ADAPTED FOR SYNCHRONOUS AND INDEPENDENT OPERATION AND METHOD OF USING SAME

[75] Inventor: Harold E. Henderson, Tyler, Tex.

[73] Assignee: National Distillers and Chemical Corporation, New York, N.Y.

[21] Appl. No.: 719,089

[22] Filed: Aug. 31, 1976

[51] Int. Cl.[2] ..... B65B 1/00; B65B 7/06; B65B 43/30; B65B 51/18

[52] U.S. Cl. ..... 53/29; 53/37; 53/190; 53/373; 53/386

[58] Field of Search ..... 53/29, 37, 187–190, 53/285, 371, 373, 384, 386; 141/114, 313, 314, 316

[56] References Cited

U.S. PATENT DOCUMENTS

| | | | |
|---|---|---|---|
| 2,732,988 | 1/1956 | Feinstein | 53/268 X |
| 3,225,515 | 12/1965 | Inglett | 53/190 |
| 3,896,605 | 7/1975 | Chevalier | 53/371 X |

*Primary Examiner*—Robert Louis Spruill
*Attorney, Agent, or Firm*—Kenneth D. Tremain

[57] ABSTRACT

A bag-hanging machine including mechanism for opening a bag on a stack of lay-flat bags supported on a tiltable support table, and transfer arms for withdrawing the opened bag and suspending the latter. A bag-filling machine includes a hopper spout for receiving the bag from the transfer arms and filling the bag with a bulk material. The filled bag has its mouth portion shaped and closed by pivotable members mounted on the hopper spout, and is then deposited on a conveyor for transport to a further bag processing station. The conveyor includes movable bag guides thereon for supporting the bag and preventing it from falling off.

30 Claims, 6 Drawing Figures

BAG-HANGING AND BAG-FILLING MACHINES ADAPTED FOR SYNCHRONOUS AND INDEPENDENT OPERATION AND METHOD OF USING SAME

FIELD OF THE INVENTION

The present invention relates to a bag-hanging machine and to a bag-filling machine, both machines adapted to be concomittantly operated in synchronous relationship, or individually employed in independent operation, and to a method of utilizing these machines. More particularly, the invention relates to an automatic bag-hanging machine adapted to rapidly and sequentially suspend bags, preferably formed of a plastic material, from the hopper spout of a bag-filling machine.

In the packaging of a wide range of bulk materials, encompassing fertilizers, chemical compounds, livestock feed mixtures, grain and cement or the like, these materials are usually packed in bags which are suitable for commerical shipping, handling and storage. The filling of these bags, the latter of which may be constituted of a suitable synthetic material such as plastic film or the like, is frequently accomplished by suspending the empty bag below a filling machine, causing the spout to open to thereby allow a desired quantity of bulk material to enter the bag, and then removing the filled bag from the filling spout to thereafter effectuate the closing and/or sealing thereof.

SUMMARY OF THE INVENTION

Basically, the bag-hanging machine according to the present invention is designed to provide a mechanism for opening the topmost bag of a superimposed stack of lay-flat bags which are positioned bag opening facing downwardly in a somewhat inclined plane relative to the horizontal, and wherein pivotable transfer arms are arranged to withdraw the opened topmost bag from the stack and to suspend the bag vertically below the spout of the hopper of a bag-filling machine.

In conjunction with the foregoing, the present invention further contemplates the utilization of another mechanism in the bag-hanging machine adapted to effect the opening of the topmost bag of the stack, comprising suction cups engageable with the upper surface of the topmost bag and displacing it upwardly, concurrent with an upward tilting of the support table on which the stack of bags is located and the introduction of a finger into the topmost bag to aid in the opening thereof, the finger being a portion of a mechanism adapted to lock the bag supporting table in a predetermined upper tilted position. Operating in synchronism with the above-mentioned mechanisms are suitable transfer arms which are pivotally or swingably supported from the frame of the bag-hanging machine, and which are adapted to clampingly engage the interior end surfaces of the open topmost bag to allow their withdrawing of the bag from the stack and to suspend it vertically below the spout of the hopper for the filling of the bag with a bulk material or derived quantity of a product.

In another aspect of the invention, the bag-filling machine, which is employed for supplying the bag suspended below the spout of its hopper with bulk material, incorporates suitable bag hopper clamps which are pivotable so as to engage cooperative gripping surfaces provided on the spout, thereby maintaining the bag in a suspended clamped relationship on the spout during the filling thereof with the bulk material. A novel feature of the bag-filling machine, as contemplated by the present invention, provides for pivotally mounted extensible stretcher arms being located below the bag hopper clamps and which are adapted to shape the mouth portion of the bag, subsequent to filling of the latter, into a narrow elongated configuration. Concurrently, bag guide members, each constituted of a rigid frame incorporating flat surfaces in parallel relationship with the stretcher arms and bag hopper clamps, are adapted to pivot together into compressive engagement with the outer sides of the filled bag immediately below the extended stretcher arms so as to close the bag neck portion while concurrently venting excess air therefrom.

Another aspect of the invention resides in that an intermittently driven conveyor is positioned below the bag-filling machine and is adapted to have filled bags deposited thereon upon the bags being released from the spout of the hopper, and to position the bags for transporation to a further processing station, for example, a bag sealing arrangement. With respect to the foregoing, the invention accordingly contemplates the use of a novel bag guide plate structure including structure for supporting the bag on at least three sides thereof when deposited onto the conveyor from the bag-filling machine, the support structure including side support plate members which are pivotable so as not to obstruct the progress of the bag while being transported on the conveyor toward a further processing or sealing station.

An advantageous feature of the present invention resides in that the continuous operations of the bag-hanging machine and the bag-filling machine may be synchronized so that while a bag is suspended from the spout of the hopper the bag-filling machine and is being filled with the bulk material, a subsequent bag is being opened in the bag-hanging machine and readied for engagement by the transfer arms and transfer thereby from the stack of bags in the bag-hanging machine to the spout of the bag-filling machine. This will allow for the continuous, uninterrupted and sequential filling of a large number of bags in an automatic manner at a rapid pace, thereby rendering the use of the inventive machines extremely attractive from a commercial standpoint.

Accordingly, it is an object of the present invention to provide a bag-hanging machine constructed to remove an empty bag from a stack of lay-flat bags, and to transfer the bag into a vertically suspended position adapted for the filling thereof with a product.

Another object of the present invention is to provide a bag-hanging machine of the above-described type which will open the bag, and which includes pivotable transfer arms adapted to transfer the open bag from a superimposed stack of lay-flat bags towards the filling spout of a bag-filling machine.

A further object of the present invention is to provide a bag-filling machine comprising a novel hopper spout incorporating structure for clamping the upper edges of an open bag suspended therebelow, and including stretcher arms and bag guide members adapted to shape the mouth portion of the filled bags and close the bag opening while concurrently venting excess air therefrom subsequent to the filling of the bag by the bag-filling machine.

Still another object of the present invention is to provide an intermittently driven conveyor below the bag-filling machine adapted to have the filled bag deposited thereon, and which incorporates a novel bag guide means for encompassing the bag on at least three sides thereof during predetermined intervals prior to the bag being transported to a further processing station.

Yet another object of this invention is to provide a method of operating a bag-hanging machine and bag-filling machine adapted to operate in synchronism for opening, transferring and filling bags with a bulk material in a rapid and automatic sequence.

BRIEF DESCRIPTION OF THE DRAWINGS

Reference may now be had to the following detailed description of a preferred embodiment of the invention taken in conjunction with the accompanying drawings, in which.

DETAILED DESCRIPTION OF THE INVENTION

In essence, the drawings diagrammatically illustrate the structure and operative relationship between an inventive bag-hanging machine A, a bag-filling machine B, and a bag conveying system C. Components of the bag-filling machine B, such as the infeed chute and the weight scale elements thereof, have been omitted from the drawings for the sake of clarity since only the spout segment of the feed hopper is of significance with regard to the present invention.

Thus, the bag-hanging machine A fulfills the primary functions of opening a bag which is in a lay-flat condition and transporting the opened bag to a suspended position, in effect, below the hopper spout of the bag-filling machine B. The basic function of the bag-filling machine B is to fill the bag which is suspended from the hopper spout thereof with a predetermined weight or quantity of a bulk product, and then permit the bag to drop onto the conveyor system C. In turn, the principal purpose of the conveyor system C is to transport the filled bag for the further treatment or handling thereof, such as the sealing of the bag through the intermediary of a suitable bag sealing arrangement.

Figure 1:
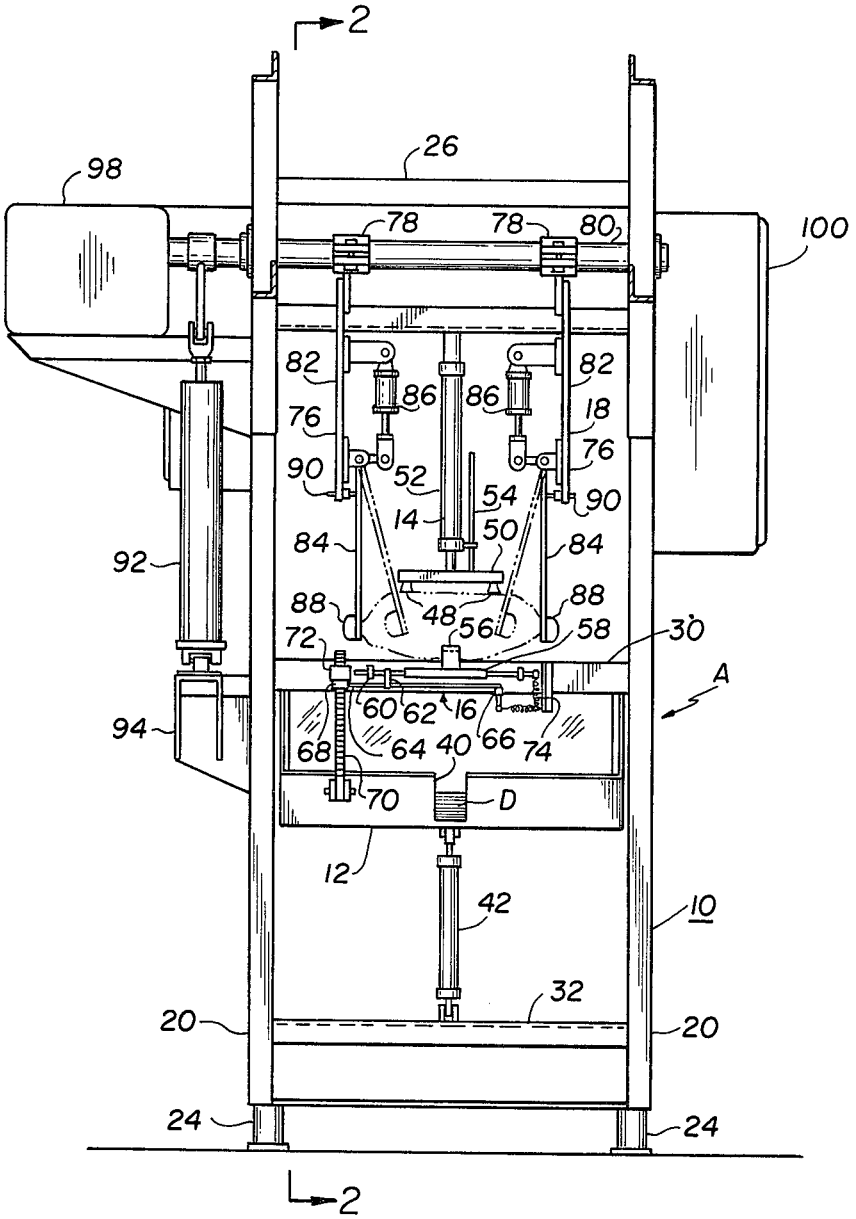
FIG. 1 is a front elevational view of a bag-hanging machine pursuant to the present invention.
Figure 2:
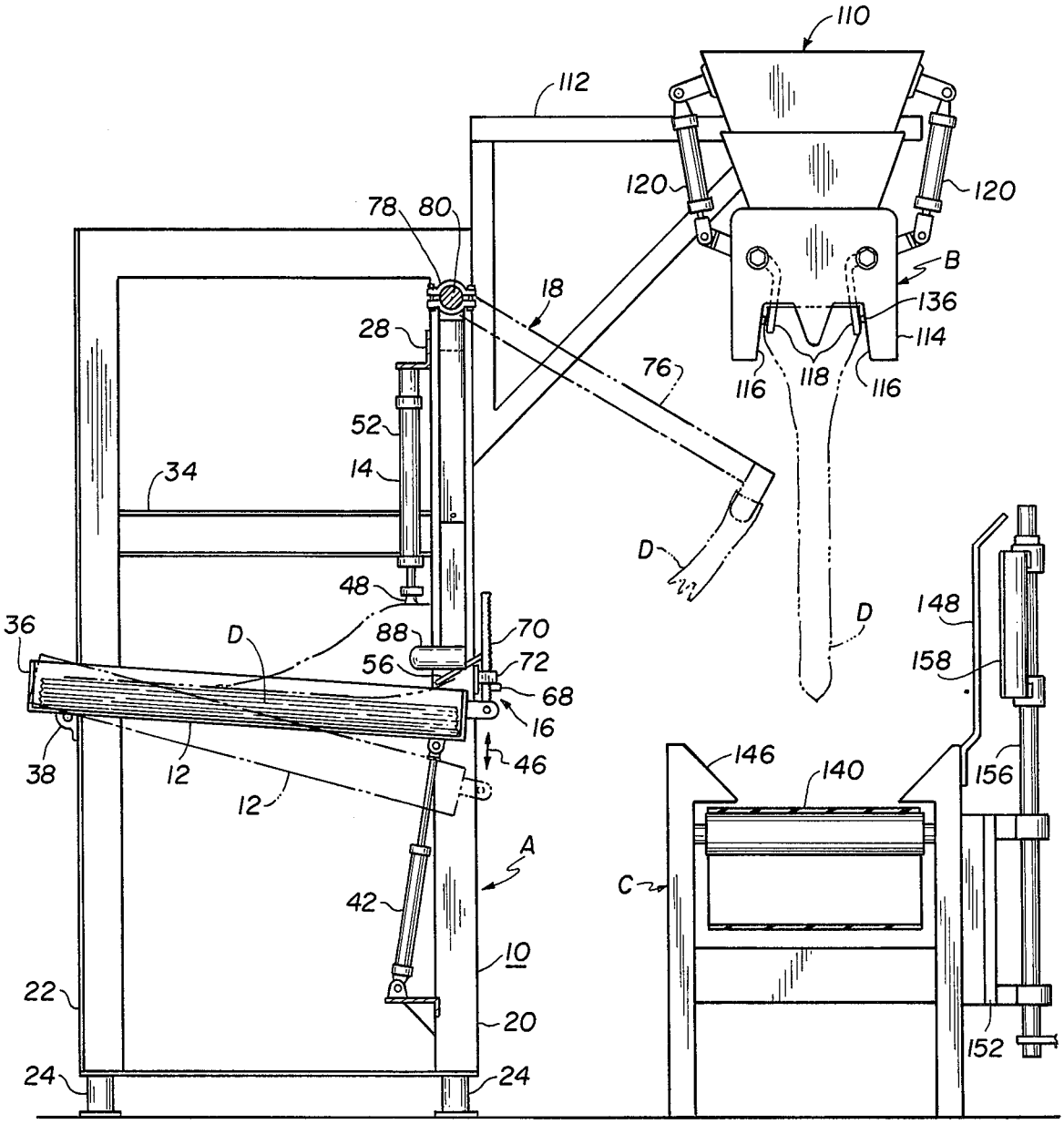
FIG. 2 is a side elevational view taken along line 2—2 in FIG. 1 and showing the machine in association with a bag-filling machine and a bag conveying system.

Reference may now be had in detail to the drawings, and particularly FIGS. 1 and 2 which are illustrative of the construction and operation of the bag-hanging machine A.

Figure 3:
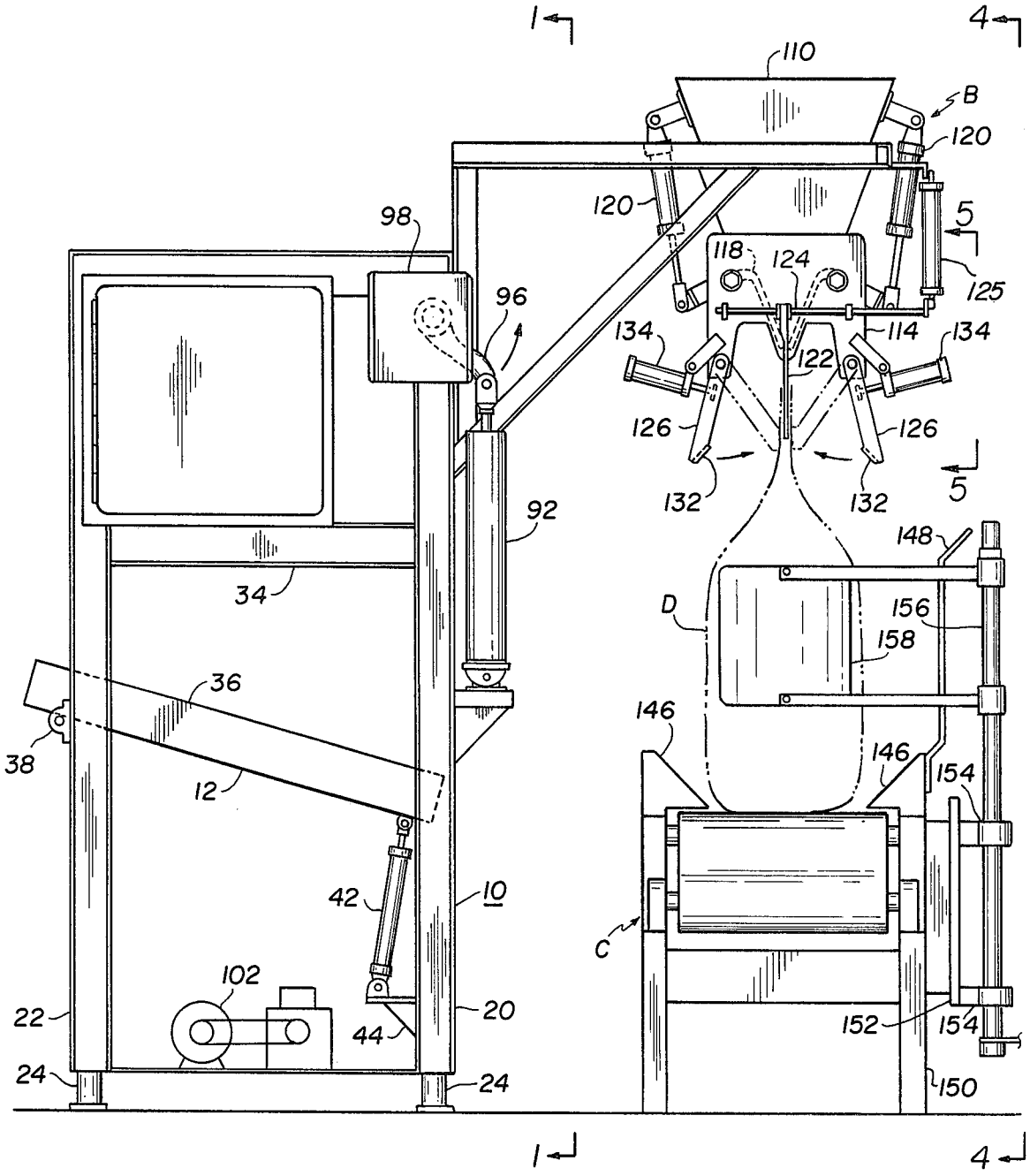
FIG. 3 is a view similar to that of FIG. 2 with the bag-filling machine illustrated at a different operative stage.
Figure 5:
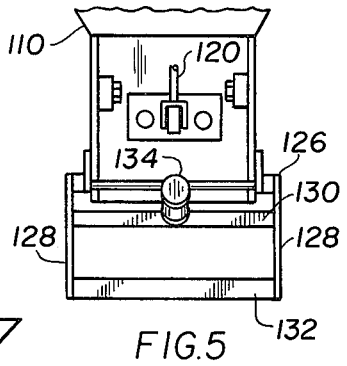
FIG. 5 is a detail view taken along line 5—5 in FIG. 4.

The bag-hanging machine A is indicated generally at 10 in FIGS. 1, 2 and 3, and includes a tiltable bag supporting table 12, a bag opening arrangement 14, a table locking mechanism 16, and a transfer arm mechanism 18.

The bag-hanging machine 10 comprises a rigid frame constituted of structural elements which are interconnected in any suitable manner, such as by welding rivets or bolts. The structural frame includes upright channels or angle members 20 and 22 respectively serving as the front and rear corner posts of the frame and which have foot portions 24 located at the lower ends thereof for supporting the bag-hanging machine 10 on a suitable base, such as a floor, ground or the like. The uprights 20 and 22, in turn, are welded to transversely extending connector angle irons or channel cross members 26, 28, 30 and 32 and side structural supports 34. The bag supporting arrangement on table 12 may consist of a receptacle 36. The table 12 is hingedly connected proximate its rear portion to the upright 22 through the intermediary of a suitable rotatable shaft and bushing assembly 38 so as to be tiltable about the shaft 38. The receptacle 36 is downwardly inclined from the horizontal towards the front end thereof and has a notch 40 cut out in the front wall thereof for purposes to be described in greater detail hereinbelow. The front end of the receptable 36 is supported on an air cylinder 42, the lower end thereof being connected to a bracket 44 which is mounted on cross member 32. The receptacle 36 is adapted to receive a plurality of lay-flat superimposed or stacked bags D having their mouths or openings facing towards the front surface of the receptacle. Actuation of air cylinder 42 permits the receptacle or table 12 to be tilted up and down about shaft 38 in the direction of arrow 46 at varying degress of inclination.

The bag opening arrangement 14 comprises a pair of downwardly facing suction cups 48 which are connected to a suitable source of suction or vacuum (not shown) through the hollow conduit 50. The suction cups 48, in turn, are supported from an air cylinder 52, the latter of which is suspended from the crossbar 28. A suitable vertical guide rod member 54 extending up from the conduit 50 is adapted to prevent rotation or displacement of the suction cups 48 about air cylinder 52 so as to maintain their orientation relative to the upper surface and mouth of the topmost bag D located in the receptable 36. As may be clearly ascertained from FIGS. 1 and 2 of the drawings, the suction cups 48 are positioned above the bags D in proximity to the mouth-end thereof, in effect, closely adjacent to the front end of the receptacle 36.

The table locking mechanism 16 of the bag-hanging machine 10 comprises a generally L-shaped finger 56 adapted to extend through the slot 40 formed in the front wall of the receptacle 36 to be contacted and rotated upwardly by the topmost bag D contained in the receptacle when the table 12 is tilted into a raised position. The finger 56 is pivotally connected to the crossbar 30 of the bag-hanging machine frame structure through the intermediary of a horizontally extending linkage shaft 58 journaled through bushings 60. A projection 62 fastened to the linkage member 58 is adapted to contact a rod 64 which is swivable at one end thereof about bushing 66 and which has a toothed member 68 mounted at its opposite free end. An upwardly directed elongate toothed rack 70 has its lower end fastened to the tiltable table 12 to thereby be capable of sliding through a bushing 72 which is fastened to the crossbar 30. The upward pivoting of finger 56 about shaft 58 will cause the projection 62 to urge the rod 64 towards the crossbar 30, thereby causing the toothed member 68 to interdigitate with the toothed rack 70 and thereby locking the table 12, and the receptacle 36 supported thereon, against further upward tilting movement. When the finger 56 is disengaged from contact with the uppermost bag D, thereby permitting the finger to swivel downwardly in a counterclockwise direction, as viewed in FIG. 2, the action of biasing springs 74, which are connected to the ends of rods 64 and 58, will cause the toothed member 68 to disengage from the toothed rack 70, thereby permitting the table 12 to drop downwardly under its own weight, providing there is no counteracting pressure in air cylinder 42.

The transfer arm mechanism 18 of the bag-hanging machine 10 comprises a pair of spaced transfer arms 76 which are fastened at their upper ends, by means of suitable gripping clamps 78, to a shaft 80 rotatably journaled through the uprights 20. Each of the transfer arms 76 consists of an upper arm portion 82 having a lower arm extension 84 hingedly connected thereto. The arm extensions 84 may be articulated towards and away from each other by means of a pair of double-acting air cylinders 86 each mounted on respectively one of the arm portions 82, wherein the lower or piston end of each of the air cylinders 86 is connected to an L-shaped or bell-crank connection of the arm extension 84. The free ends of each of the arms 84 includes a finger portion 88 adapted to enter the interior of the topmost bag D stacked in the receptacle 36 on the tiltable table 12. Adjustable stops 90 are provided on each of the upper arm portions 82 so as to controllably limit the outward pivoting movement of the arm extensions 84 relative to each other. Pivoting motion between a vertically downward position and a horizontal raised position is imparted to the transfer arms 76 by rotation of shaft 80 responsive to actuation of air cylinder 92, the latter being mounted on a bracket 94 forming a component of the stationary frame structure of the bag-hanging machine 10. A cam crankarm 96 interconnects the piston of air cylinder 92 with the shaft 80. Actuation of the air cylinder 92 is effectuated through a suitable control unit 98, schematically illustrated in FIGS. 1 to 3 of the drawings, which may consist of a plurality of cams selectively actuating suitable solenoid switches for controlling the sequence of operation of the transfer arms 76. The spacing between the transfer arms 76 may be readily varied by spatial adjustment between the gripping clamps 78 on shaft 80 so as to accommodate the transfer of bags having different widths from the receptacle 36.

The fingers 88 which are mounted at the distal or lower ends of arm extensions 84 are located on the outer faces thereof and extend perpendicularly thereto so as to be readily insertable into the open end or mouth of the topmost bag D stacked on receptable 36.

An electrical control panel 100 containing suitable controls (not shown) may be mounted on the stationary frame structure of the bag-hanging machine 10, although it is readily apparent that the control panel may be positioned at a remote location. Furthermore, a vacuum motor and pump unit 102 may be positioned on a base plate of the frame structure of the bag-hanging machine for producing the required vacuum or suction which is supplied to the suction cups 48, although, if desired, the unit 102 may also be positioned at a location remote from the machine. The electrical controls are adapted to provide the necessary operating sequences for the movable components of the bag-hanging machine 10.

Referring now in detail to the construction of the bag filling machine B, as illustrated in FIGS. 2 through 6 of the drawings, the machine includes a bag filling hopper 110. Preferably, although not necessarily, the filling machine is structurally fixedly connected to the bag-hanging machine 10 through the employment of a rigid support frame 112. The support frame 112 may be welded, or detachably bolted on the bag-hanging machine to allow for the independent operation of either the bag-hanging machine or the bag-filling machine.

The material feed hopper 110 may be of a construction known in the art and may incorporate a suitable material infeed arrangement and weight scale (not shown) for supplying predetermined quantities of bulk material thereto which is to be introduced into a bag suspended from the spout of the hopper.

The hopper 110 comprises a spout 114 including bag gripping surfaces 116 and hopper clamps 118, the latter of which are adapted to be articulated between a hopper closing position (clamped together) as shown in FIG. 3 and a bag clamping position (contacting surfaces 116) as illustrated in FIG. 2 of the drawings. Articulation is imparted to the hopper clamps 118 by means of a pair of double-acting air cylinders 120.

Extending below the hopper clamps 118, and centrally of hopper 110, are a pair of essentially L-shaped bag stretcher arms 122. The stretcher arms 122 are manipulated through the action of a suitable linkage arrangement 124 responsive to actuation of air cylinder 125 so as to either be in a downwardly folded-in condition, as shown in phantom lines in FIG. 4 of the drawings, or in an extended bag stretching condition as shown in solid lines in FIGS. 3 and 4.

Hingedly fastened to the spout 114 of the hopper 110, exteriorly of the gripping surfaces 116, are bag guide members 126 each comprising a rigid frame formed of depending end bars or members 128 interconnected by transverse crossbars or plates 130 and a bag-contacting flat-surfaced crossbar member 132. Articulation is imparted to the bag guide members 126 through the intermediary of air cylinders 134, which are pivotally connected to the spout 114.

Upon a bag D being suspended in a filling position below the spout 114, namely, between the bag gripping surfaces 116 so that the hopper clamps 18 extend interiorly of the mouth of the bag, actuation of air cylinder 120 will cause the hopper clamps 118 to assume an outwardly spreading position as shown in FIG. 2 of the drawings to thusly clamp the upper bag edge portions between gripping surfaces 116 and hopper clamps 116. Sensing of the presence of a bag on the spout 114 may be effectuated through suitable sensing switches 136 located on the surface of at least one of the grippers 116.

Figure 4:
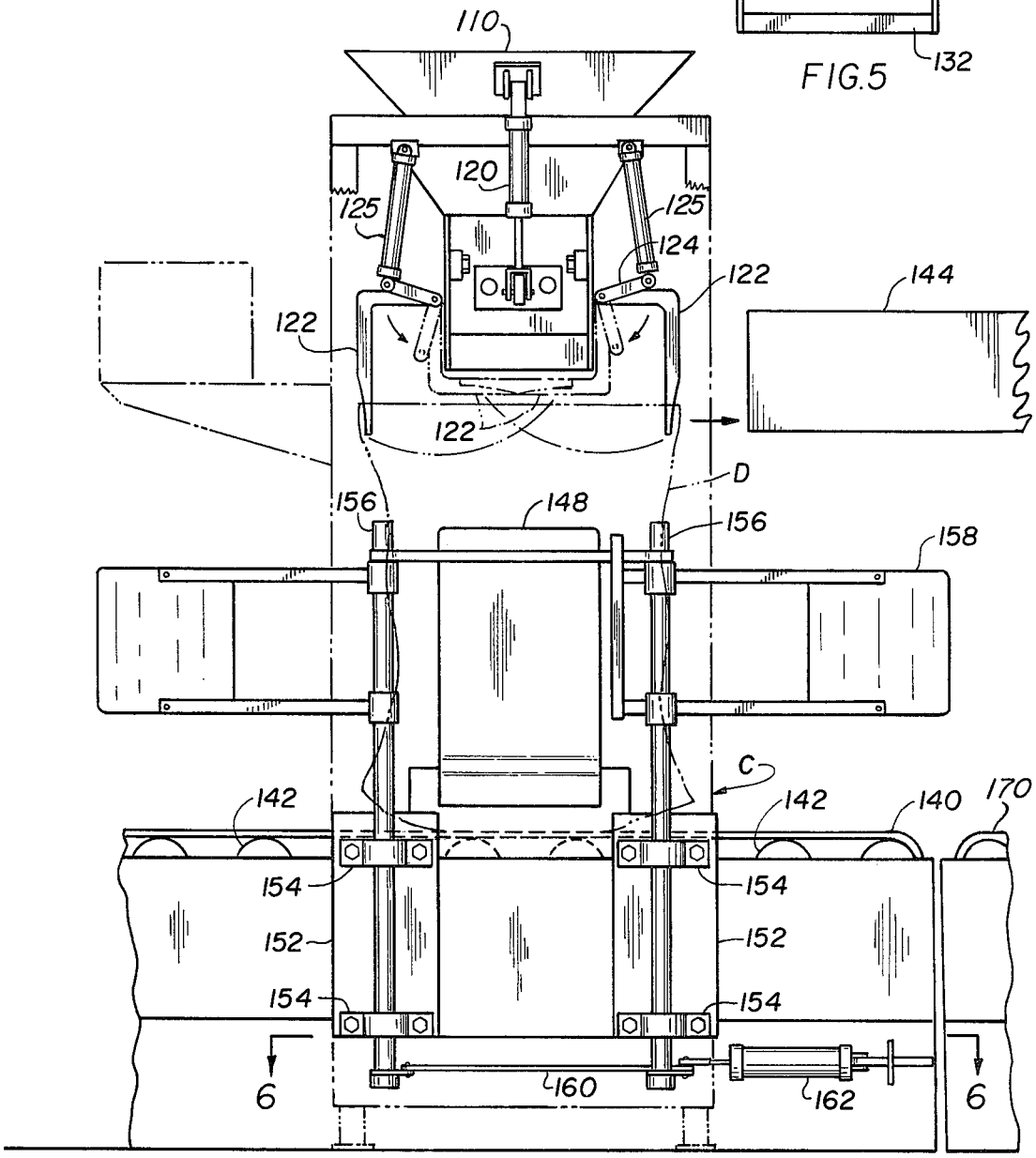
FIG. 4 is an elevational view of the bag-filling machine as viewed in the direction of line 4—4 in FIG. 3.
Figure 6:
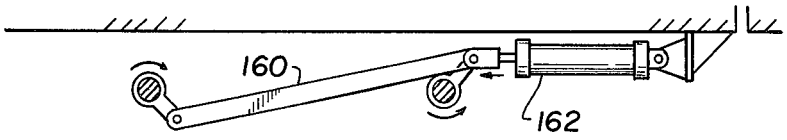
FIG. 6 is a sectional view taken along line 6—6 in FIG. 4.

Upon a bag D being filled by bulk material supplied through hopper 110, suitable controls (not shown) will cause the hopper clamps 118 to return to their initial hopper closing position as illustrated in FIG. 3 of the drawings, thereby releasing the filled bag and allowing the latter to drop downwardly from the spout. Concurrently, the stretcher arms 122 will be extended apart as shown in FIG. 4 of the drawings to thereby form the upper or mouth portion of the filled bag D into a narrow elongate configuration. At that time, the bag guide members 126 will close towards each other, causing surfaces 132 to contact and compress the upper portion of the filled bag immediately below the extended stretcher arms 122, as shown in phantom in FIG. 3, thereby causing excess air to be expelled from the mouth of the filled bag while concurrently closing the bag opening.

Desirably, a conveyor belt system C may be arranged below the hopper 110 to facilitate the filled bag D to be deposited on the upper run 140 of an endless conveyor belt upon being released from the spout 114. The conveyor belt is driven by a suitable power source (not shown), with the upper run 140 being supported on a series of rotatable rollers 142. The conveyor belt is adapted to be driven in an intermittent operating mode timed to be stationary when the bag is deposited thereon from the spout of the hopper 110, and then placed into motion to transport the filled bag onto a continuously driven conveyor belt 170, which is contiguous with the conveyor belt 140, beneath a suitable sealing arrangement 144 adapted to seal the neck or mouth portion of the filled bag. When the bag is constituted of a heat-sealable material, such as polyethylene plastic or the like, the sealing arrangement may be a heat sealer, for instance, a band heat sealer sold under the trademark "Doughboy" by Doughboy Industries, Inc., New Richmond, Wis.

Suitable bag guide inclines 146 may be provided to extend along both sides of the conveyor belt 140, and a rigid upright backing plate 148 may be fastened to a stationary frame 150 supporting the conveyor belt.

As illustrated in FIG. 4 of the drawings, a pair of plates 152 each mounting vertically spaced bearings 154 are fastened to the stationary frame 150 at one side of the conveyor run 140 on either side of the back support plate 148. Pivotable vertical shafts 156 extend through the bearings 154 and are adapted to support horizontally extending bars mounting side wing plates 158 on either side of the stationary back support plate 148. Each of the plates 158 may be curved to generally conform to the curved configuration of the filled bag D being deposited on the conveyor run 140 and prevent the bag from falling off.

Connected to the lower ends of each of the vertical shafts 156 is a system of interconnected linkages 160 which is articulated by an air cylinder 162 to facilitate pivoting of each of the side wing plates 158 across the conveyor run at right angles to back support plate 148 and guidingly encompass the sides of the filled bag which has deposited on the belt run 140 in the stationary operating mode of the latter, and to pivot the plates 158 outwardly into coextensive parallel relationship with plate 148 out of the path of the conveyor run 140 when the latter is set into motion, to allow the bag D to be conveyed towards the sealing arrangement 144.

In order to allow for the processing of bags of varying lengths, in effect, lengthier bags, the vertical elevation of the conveyor system below the bag-filling machine may be made adjustable. This can be readily achieved by mounting the conveyor system on vertically adjustable pedestals or supports.

The operation of the bag-hanging machine, bag-filling machine, and conveyor system is now described in detail hereinbelow.

(a) Operation of Bag-hanging Apparatus

The bag transfer arms 76, while gripping a bag D, are pivoted through rotation of shaft 80 responsive to actuation of air cylinder 92 upwardly from vertically downwardly dependent position, as shown in solid lines in FIG. 2, towards a horizontally extending bag suspending position. Concurrently, the vacuum cups 48 are moved downwardly towards the topmost bag D which is stacked in the receptacle 36 on inclined table 12 through the intermediary of pressure being supplied to the air cylinder 52.

At that time, by means of pressure being supplied to air cylinder 42, the forward end of the table 12, and the receptacle 36 supported thereon, is tilted upwardly in the direction of arrow 46 to thereby cause the suction cups to contact the upper surface of the topmost bag on the stack. Vacuum is now supplied to the suction cups 48 through conduit 50 so as to enable the cups to grip the upper surface of the topmost bag of the stack.

As the table 12 is tilted upwardly in the direction of arrow 46, the topmost bag of the stack in receptacle 36 will contact finger 56, the latter of which extends inwardly of the receptacle through the notch 40, so as to impart a clockwise rotation to the finger about shaft 58. This, in turn, will cause the projection 62 on shaft 58 to push rod 64 and cause the toothed member 68 located at the end thereof to move into interdigitating engagement with the upstanding toothed rack 70 fastened to the table 12, thereby restraining and locking the table 12 against further upward tilting movement.

The vacuum cups 48 are now displaced upwardly under the action of pressure being supplied to the lower portion of air cylinder 52, concurrently vacuum being maintained in the suction cups to cause them to pull open the topmost bag and to maintain it in that opened position.

As the upper wall of the topmost bag is displaced upwardly responsive to the pulling action of vacuum cups 48, the finger 56 slides off the edge of the top wall surface thereof and is rotated downwardly, or counterclockwise about shaft 58 under the urging of biasing springs 74. This will effect disengagement beween the toothed member 68 and toothed rack 70 so as to permit the table to drop down under its own weight with the remaining stack of bags. The tip of the finger 56 still projects inwardly of the opened topmost bag and remains in engagement with the bottom interior wall surface of the opened topmost bag to thereby aid in maintaining the bag in an opened position in cooperative operative relationship with the suction cups 48.

The transfer arms 76, from which the suspended bag D have previously been removed, have their lower arm extensions 84 pivoted towards each other under the urging of the pressure and air cylinders 86 so as to permit the fingers 88 mounted at the lower ends thereof to extend interiorly of the opened topmost bag on the stack. Thereafter, pressure is reversed in air cylinders 86 causing the outsides of the fingers 88 to grippingly engage or contact the interior end walls of the opened bag. Thereafter, the transfer arms 76 are again elevated to a horizontal position with the bag clamped therebetween for suspending the latter in a vertical position, and the operating cycle of the bag-hanging machine is then repeated for a subsequent bag.

(b) Operation of the Bag-filling Machine

The operation of the bag-filling machine is now described in conjunction with synchronous operation thereof with the bag-hanging machine.

When no bag is suspended from the spout 114 of the hopper 110, the bag hopper clamps 118 are in a closed position, as shown in phantom lines in FIG. 3 of the drawings, the bag guide members 126 are fully separated and the stretcher arms 122 are closed below the bag hopper clamps 118, as shown in phantom lines in FIG. 4 of the drawings.

Upon the transfer arms 76 of the bag-hanging machine moving a bag below the spout 114 so that the bag hopper clamps 118 extend interiorly of the mouth of the bag, the bag hopper clamps are extended or spread outwardly through pressure being applied to air cylinders 120 to thereby clamp the upper edges of the suspended bag D against the gripping surfaces 116 on the spout 114, as is illustrated in FIG. 2 of the drawings. When the presence of a suspended clamped bag is sensed, preferably by means of a suitable sensor switch or contact 136 located on the face of at least one of the gripping surfaces 116, a predetermined weight or quantity of product (measured by a hopper scale not shown herein), will be dispensed through the hopper 110 and spout 114 into the bag. Immediately preceding the upper edge of the bag being clamped between the hopper bag clamps 118 and gripping surfaces 116, the transfer arms are pivoted slightly above their horizontal position so as to permit the fingers 88 to slide out of and disengage from the bag and to be pivoted outwardly thereof, whereupon the transfer arms 76 are then pivoted downwardly towards the bag-hanging machine to be in position for fingers 88 engaging a subsequent bag for transfer to the bag-filling machine.

When the bag has received its required quota of bulk material, the bag hopper clamps 118 are again closed, thereby releasing the bag from clamping engagement with the gripping surfaces 116, thusly allowing the bag to drop downwardly.

At that time, the stretcher arms 122 are extended apart, as shown in FIG. 4 of the drawings, so as to shape the opening of the bag into a narrow elongate configuration. Concurrently, the bag guide members 126 are closed against the side surface of the bag, as shown in phantom lines in FIG. 3 of the drawings, causing the flat surfaces 132 to close the bag neck portion while concurrently venting excess air therefrom. Thereafter, the stretcher arms 122 are again retracted below the hopper clamps, and the bag guide members 126 are spread apart to permit the positioning of a subsequent bag on the spout 114 by the transfer arms 76.

The filled bag which has been released by the bag-filling machine may be permitted to drop down onto the upper run 140 of an intermittently driven conveyor belt which is in a stationary operating mode during that time, and which will then subsequently be set into motion for conveying the filled bags towards the bag sealing arrangement 144. The action of the stretcher arms 122 and bag guide member 126 will cause the narrow flattened bag top or mouth portion to be aligned with the inlet to the bag sealing arrangement 144, thereby assuring that the bag will be properly sealed. This may be readily accomplished by providing a pair of converging movable conveyor bands on the sealing arrangement 144 which will engage the leading edge of the neck portion of the filled bag to draw it into the sealing arrangement.

As the bag is deposited on the conveyor belt run 140, it is supported against tilting over and falling off by a back support plate 148 and a pair of pivotable side wing plates 158 conjointly encompassing at least three sides of the bag. When the bag is to be conveyed towards the sealing arrangement 144 by movement of the conveyor belt 140, the air cylinder 162 will actuate linkage system 160 to thereby pivot the side wing plates 158 out of the path of the conveyor run and into a coextensive parallel relationship with the back support plate 148.

From the foregoing, it becomes readily apparent that the bag-hanging machine, bag-filling machine and conveyor system provides for a unique and advantageous installation for suspending and filling bags which are adapted to be filled with a bulk material in a rapid sequence so as to render the entire installation advantageously economical from a commercial standpoint.

Moreover, it is evident that the installation is adapted to handle bags of different sizes, in view of the spacing between the transfer 76 being easily adjustable for accommodating bags of different widths, the conveyor system being raisable or lowerable to accommodate bags of different lengths, and the bag guide members 126 possibly being adjustable to compensate for bags receiving different amounts of bulk material.

It is readily apparent to one skilled in the art that numerous modifications are possible within the context of the above disclosure and, accordingly, it is to be understood that, within the scope of the claims, the invention may be practiced otherwise than specifically described.

What is claimed is:

1. A bag-hanging machine, comprising a frame; a table pivotally mounted on said frame for supporting a stack of lay-flat bags in an inclined position with the mouths of the bags facing towards the lower end of the incline, means for tilting the lower end of said inclined table upwardly;

bag opening means including depending suction cups disposed in a plane above said stack of bags adjacent the mouths thereof, means for displacing said suction cups downwardly into contact with the upper surface of the topmost bag of said stack in synchronism with said tilting means effectuating upward tilting of said table, means for imparting a vacuum to said suction cups for grippingly engaging said bag surface, means for locking said table at a predetermined upper tilted position, said suction cup displacing means being adapted to concurrently raise said suction cups and the upper surface of said topmost bag to thereby open the mouth of the bag;

a pair of spaced bag transfer arms pivotally mounted on said frame at their upper ends above said tiltable table; means for pivoting said bag transfer arms between a lower position for insertion of said arms into the opened mouth of the topmost bag on the stack and a raised position for lifting said bag from said stack and suspending said bag; and means for pivotally inclining said bag transfer arms towards and away from each other.

2. A machine as claimed in claim 1, said means for locking said table comprising a bag opening finger; means pivotally mounting said finger on said frame above the lower end of said tiltable table; a bag-receiving receptable being supported on said table; a slot formed in the front wall of said receptacle facilitating ingress of said finger and upward rotation of the latter upon contacting the topmost bag during upward tilting movement of said table; and interdigitating means articulated in response to the upward rotation of said finger locking said tiltable table in the predetermined upwardly tilted position thereof, said finger being adapted to engage the interior of the lower mouth portion of said topmost bag to aid said suction cups in maintaining said bag in an opened condition.

3. A machine as claimed in claim 2, said interdigitating means comprising a toothed rack mounted on said table; and linkage arm means having a toothed member operatively connected to said finger adapted to cooperatively engage said toothed rack to restrict continued upward tilting movement of said table.

4. A machine as claimed in claim 3, comprising resilient biasing means connected to said linkage arm means for imparting downward rotation to said finger and disengaging said toothed member and toothed rack to facilitate downward tilting of said table responsive to deactivation of said table tilting means.

5. A machine as claimed in claim 1, comprising a finger member on the outer face of the lowermost end of each said bag transfer arm extending towards said table, said finger member being engageable with the interior wall surface of the topmost open-mouthed bag located on said stack.

6. A machine as claimed in claim 1, comprising a horizontal shaft rotatably journaled on said frame above said table, each said transfer arm including an upper arm portion having the upper ends thereof fixedly fastened to said shaft and a lower arm portion having the upper end thereof hingedly connected to the lower end of said upper arm portion for pivotal movement toward and away from each other, said means for pivoting said lower arm portions comprising a pair of air cylinders each mounted on respectively one said upper arm portion and being operatively connected to an associated lower arm portion.

7. A machine as claimed in claim 6, said means for pivoting said transfer arms between the lowered and raised positions thereof comprising an air cylinder and a crankarm actuated by said air cylinder mounted intermediate said frame and said rotatable horizontal shaft.

8. A machine as claimed in claim 1, said table tilting means comprising an air cylinder.

9. A machine as claimed in claim 1, said means for pivoting said bag transfer arms toward and away from each other biasing said transfer arms away from each other upon insertion into said open-mouthed topmost bag and during raising thereof, and inclining said transfer arms toward each other during downward pivoting of said transfer arms.

10. A machine as claimed in claim 6, comprising adjustable stop means mounted on said upper arm portions for limiting the extent of outward pivoting of said lower arm portions relative to each other.

11. In a bag-filling machine including a hopper having a filling spout; means on said filling spout for alternately grasping and releasing the top edges of a bag suspended therebelow, said means including bag grippers spaced to receive the top edges of said bag therebetween and hopper clamps receivable within said bag upon the latter being positioned intermediate said grippers; and actuating means for opening said hopper clamps for clamping the top edges of said bag against said grippers responsive to the presence of a bag at said grippers, the improvement comprising: pivotable bag stretcher arms mounted on said hopper and extending below said spout in coplanar relationship with said hopper clamps in the closed position of the latter; spaced bag guide members hingedly mounted on said hopper exteriorly of said bag grippers and depending therebelow, said bag guide members extending in generally parallel relationship with said hopper clamps, grippers and stretcher arms; actuating means for retracting said stretcher arms below said hopper clamps during intervals of suspending a bag on said filling spout and the filling thereof and for extending apart said stretcher arms responsive to a filled bag being released by said hopper clamps to project into and shape the upper portion of said filled bag into a narrow elongate configuration; and further actuating means for closing said bag guide members against the exterior sides of the upper portion of the bag concurrent with the extension of said stretcher arms for closing the bag and exhausting air from the top thereof.

12. A machine as claimed in claim 11, each said stretcher arm comprising an essentially L-shaped angle member having one end hingedly fastened to said hopper.

13. A machine as claimed in claim 11, each said bag guide member comprising a rigid frame structure having depending members hingedly fastened to said hopper, and a generally flat-surfaced crossbar member extending between said depending members adapted to contact the side of the filled bag.

14. A machine as claimed in claim 13, said crossbar members on said bag guide members being closable against the sides of said filled bag below said extended apart stretcher arms.

15. A machine as claimed in claim 11, said actuating means for said stretcher arms comprising linkage arms interconnecting said stretcher arms, and air cylinder means for articulating said linkage arms.

16. A machine as claimed in claim 11, said actuating means for each said bag guide member comprising an air cylinder.

17. A machine as claimed in claim 11, comprising an intermittently driven conveyor belt positioned below said hopper adapted to receive filled bags released from said spout; a stationary frame structure supporting said conveyor belt; and bag guide support means fastened to said stationary frame structure for supporting said bag along three sides thereof upon said bag being deposited on said conveyor belt from said hopper.

18. A machine as claimed in claim 17, said bag guide support means comprising an upright back support plate extending vertically above and proximate one side of said conveyor belt; side wing plates flanking said back support plate; and means mounting said side wing plates for pivotal motion into bag side encompassing positions extending across said conveyor belt during stationary periods of the latter when the filled bag is deposited thereon and for pivoting said side wing plates into coextensive parallel relationship with said back support plate during operative intervals of said conveyor belt.

19. A machine as claimed in claim 18, said pivoting means for said side wing plates comprising linkage arms articulatedly mounted said plates on said stationary frame structure; and air cylinder means for manipulating said linkage arms.

20. A machine as claimed in claim 17, comprising a continuously driven conveyor belt positioned contiguous to said intermittently driven conveyor belt for receiving filled bags from the latter; and bag sealing means being positioned above said continuously driven conveyor belt for sealing the upper ends of the filled bags.

21. A machine as claimed in claim 20, said bag sealing means comprising a band heat sealer.

22. A method of conveying a bag from a stack of lay-flat, superimposed bags to a bag-filling machine having a hopper below which said bag is suspended, comprising the steps of: elevating the mouth-ends of the stack of bags; concurrently engaging the upper surface of the topmost bag with suction means, raising said suction means in conjunction with said topmost bag, engaging the mouth-end portion of said topmost bag with a finger to aid in opening said bag while concurrently locking said stack of bags against further elevating movement, inserting depending transfer arms into said open bag mouth, spreading said transfer arms to grippingly engage the inner end wall of said bag, and pivoting said transfer arms and bag gripped therebetween upwardly to the spout of said hopper.

23. A method as claimed in claim 22, comprising clamping said bag to said hopper spout, filling and releasing said bag, introducing means into the upper end of said bag for deforming the top portion thereof into a narrow elongate configuration, and compressing the sides of the upper end of said filled bag for closing the latter and venting air therefrom.

24. A method as claimed in claim 23, comprising positioning said filled bag on an intermittently driven conveyor belt for transportation towards a bag sealing arrangement.

25. A bag-hanging and filling apparatus for the sequential processing of bags, comprising in combination:

(a) a bag-hanging device including a frame; a table pivotally mounted on said frame for supporting a stack of lay-flat bags in an inclined position with the mouths of the bags facing towards the lower end of the incline, means for tilting the lower end of said inclined table upwardly; bag opening means including depending suction cups disposed in a plane above said stack of bags adjacent the mouths thereof, means for displacing said suction cups downwardly into contact with the upper surface of the topmost bag of said stack in synchronism with said tilting means effectuating upward tilting of said table, means for imparting a vacuum to said section cups for grippingly engaging said bag surface, means for locking said table at a predetermined upper tilted position, said suction cup displacing means being adapted to concurrently raise said suction cups and the upper surface of said topmost bag to thereby open the mouth of the bag; a pair of spaced bag tranfer arms pivotally mounted on said frame at their upper ends above said tiltable table; means for pivoting said bag transfer arms between a lower position for insertion of said arms into the opened mouth of the topmost bag on the stack and a raised position for lifting said bag from said stack and suspending said bag; and means for pivotally inclining said bag transfer arms toward and away from each other;

(b) a bag-filling device including a hopper having a filling spout; means on said filling spout for alternately grasping and releasing the top edges of a bag suspended therebelow, said means including bag grippers spaced to receive the top edges of said bag therebetween and hopper clamps receivable within said bag upon the latter being positioned intermediate said grippers; actuating means for opening said hopper clamps to clamp the top edges of said bag against said grippers responsive to the presence of a bag at said grippers; pivotable bag stretcher arms mounted on said hopper and extending below said spout in coplanar relationship with said hopper clamps in the closed position of the latter; spaced bag guide members hingedly mounted on said hopper exteriorly of said bag grippers and depending therebelow, said bag guide members extending in generally parallel relationship with said hopper clamps, grippers and stretcher arms; actuating means for retracting said stretcher arms below said hopper clamps during intervals of suspending a bag on said filling spout and the filling thereof and for extending apart said stretcher arms responsive to a filled bag being released by said hopper clamps to project into and shape the upper portion of said filled bag into a narrow elongate configuration; and further actuating means for closing said bag guide members against the exterior sides of the upper portion of the bag concurrent with the extension of said stretcher arms for closing the bag and exhausting air from the top thereof.

26. A machine as claimed in claim 25, comprising an intermittently driven conveyor belt positioned below said hopper adapted to receive filled bags released from said spout; a stationary frame structure supporting said conveyor belt; and bag guide support means fastened to said stationary frame structure for supporting said bag along three sides thereof upon being deposited on said conveyor belt from said hopper.

27. A machine as claimed in claim 26, said bag guide support means comprising an upright back support plate extending vertically above and proximate one side of said conveyor belt; side wing plates flanking said back support plate; and means mounting said side wing plates for pivotal motion into bag side encompassing positions extending across said conveyor belt during stationary periods of the latter when the filled bag is deposited thereon and for pivoting said side wing plates into coextensive parallel relationship with said back support plate during operative intervals of said conveyor belt.

28. A machine as claimed in claim 27, said pivoting means for said side wing plates comprising linkage arms articulatedly mounting said plates on said stationary frame structure; and air cylinder means for manipulating said linkage arms.

29. A machine as claimed in claim 26, comprising a continuously driven conveyor belt positioned contiguous to said intermittently driven conveyor belt for receiving filled bags from the latter; and bag sealing means being positioned above said continuously driven conveyor belt for sealing the upper ends of the filled bags.

30. A machine as claimed in claim 29, said bag sealing means comprising a band heat sealer.

* * * * *